US008007603B2

(12) United States Patent
Garcia et al.

(10) Patent No.: US 8,007,603 B2
(45) Date of Patent: Aug. 30, 2011

(54) HIGH-STRENGTH STEEL FOR SEAMLESS, WELDABLE STEEL PIPES

(75) Inventors: Alfonso Izquierdo Garcia, Veracruz (MX); Héctor Manuel Quintanilla Carmona, Veracruz (MX); Marco Mario Tivelli, Bergamo (IT); Ettore Anelli, Bergamo (IT); Andrea Di Schino, Bergamo (IT)

(73) Assignee: Tenaris Connections Limited, Kingstown (VC)

( * ) Notice: Subject to any disclaimer, the term of this patent is extended or adjusted under 35 U.S.C. 154(b) by 529 days.

(21) Appl. No.: 11/997,900

(22) PCT Filed: Aug. 1, 2006

(86) PCT No.: PCT/EP2006/007612

§ 371 (c)(1),
(2), (4) Date: Jun. 18, 2008

(87) PCT Pub. No.: WO2007/017161

PCT Pub. Date: Feb. 15, 2007

(65) Prior Publication Data

US 2008/0314481 A1 Dec. 25, 2008

(30) Foreign Application Priority Data

Aug. 4, 2005 (MX) ..... PA/A/2005/008339

(51) Int. Cl.
*C22C 38/44* (2006.01)
*C21D 8/10* (2006.01)

(52) U.S. Cl. ..... 148/335; 148/333; 148/334; 148/591; 148/593

(58) Field of Classification Search ..... 148/333–335, 148/591, 593, 909; 420/104–111
See application file for complete search history.

(56) References Cited

U.S. PATENT DOCUMENTS 4,407,681 A 10/1983 Ina et al.
4,721,536 A 1/1988 Koch (Continued)

FOREIGN PATENT DOCUMENTS

EP 0 658 632 A 6/1995

(Continued)

OTHER PUBLICATIONS

Davis, J.R. et al. "ASM Specialty Handbook —Carbon and alloy steels" ASM Specialty Handbook, Carbon and Alloy Steels, 1996, pp. 12-27, XP002364757 US.

(Continued)

*Primary Examiner* — Deborah Yee
(74) *Attorney, Agent, or Firm* — Knobbe Martens Olson & Bear, LLP

(57) ABSTRACT

A low-alloy steel containing, by weight percent, C 0.03-0.13%, Mn 0.90-1.80%, Si≦0.40%, P≦0.020%, S≦0.005%, Ni 0.10-1.00%, Cr 0.20-1.20%, Mo 0.15-0.80%, Ca≦0.040%, V≦0.10%, Nb≦0.040%, Ti≦0.020% and N≦0.011% for making high-strength, weldable steel seamless pipe, characterized in that the microstructure of the alloy steel is a mixture of bainite and martensite and the yield stress is at least 621 MPa (90 Ksi).

It is a second object of the present invention to provide a high-strength, weldable steel seamless pipe, comprising an alloy steel containing, by weight percent, C 0.03-0.13%, Mn 0.90-1.80%, Si≦0.40%, P≦0.020%, S≦0.005%, Ni 0.10-1.00%, Cr 0.20-1.20%, Mo 0.15-0.80%, Ca≦0.040%, V≦≦0.10%, Nb≦0.040%, Ti≦0.020% and N≦0.011% also characterized in that the microstructure of the alloy steel is predominantly martensite and the yield stress is at least 690 MPa (100 ksi).

11 Claims, 3 Drawing Sheets

U.S. PATENT DOCUMENTS

| | | | |
|---|---|---|---|
| 4,814,141 | A | 3/1989 | Imai et al. |
| 5,454,883 | A | 10/1995 | Yoshie et al. |
| 6,217,676 | B1 | 4/2001 | Takabe et al. |
| 7,744,708 | B2 | 6/2010 | Lopez et al. |
| 7,862,667 | B2 | 1/2011 | Turconi et al. |
| 2002/0011284 | A1 | 1/2002 | Von Hagen et al. |
| 2003/0155052 | A1 | 8/2003 | Kondo |
| 2005/0076975 | A1 | 4/2005 | Lopez |
| 2005/0087269 | A1 | 4/2005 | Merwin |
| 2007/0089813 | A1 | 4/2007 | Tivelli et al. |
| 2008/0047635 | A1 | 2/2008 | Kondo et al. |
| 2008/0219878 | A1 | 9/2008 | Kondo et al. |
| 2010/0068549 | A1 | 3/2010 | Agazzi et al. |
| 2010/0193085 | A1 | 8/2010 | Garcia et al. |
| 2010/0294401 | A1 | 11/2010 | Gomez et al. |
| 2010/0319814 | A1 | 12/2010 | Perez et al. |
| 2010/0327550 | A1 | 12/2010 | Lopez et al. |

FOREIGN PATENT DOCUMENTS

| | | | | |
|---|---|---|---|---|
| EP | 0 828 007 | A | | 3/1998 |
| EP | 1 008 660 | A | | 6/2000 |
| EP | 1 413 639 | A | | 4/2004 |
| JP | 60-86209 | | | 5/1985 |
| JP | 61-270355 | | | 11/1986 |
| JP | 403006329 | | * | 1/1991 |
| JP | 08 311551 | A | | 11/1996 |
| JP | 09 235617 | A | | 9/1997 |
| JP | 10176239 | | | 6/1998 |
| JP | 10 280037 | A | | 10/1998 |
| JP | 11 050148 | | | 2/1999 |
| JP | 11140580 | | | 5/1999 |
| JP | 11229079 | | | 8/1999 |
| JP | 2000-063940 | | | 2/2000 |
| JP | 2001-131698 | | | 10/2001 |
| JP | 2001-271134 | A | | 10/2001 |
| WO | WO 00/70107 | A | | 11/2000 |
| WO | WO 03/033856 | A | | 4/2003 |
| WO | WO 2004/031420 | | | 4/2004 |
| WO | WO 2004/097059 | A1 | | 11/2004 |
| WO | WO 2008/127084 | A2 | | 10/2008 |

OTHER PUBLICATIONS

Written Opinion dated Aug. 10, 2007 for PCT Appl. No. PCT/EP2006/007612.

Response to Written Opinion dated Sep. 6, 2007 for PCT Appl. No. PCT/EP2006/007612.

Written Opinion dated Jul. 11, 2007 for PCT Appl. No. PCT/EP2006/007612.

Response to Written Opinion dated Jun. 4, 2007. (Amendments under PCT Article 34) for PCT Appl. No. PCT/EP2006/007612.

U.S. Appl. No. 12/979,058, filed Dec. 27, 2010 and its ongoing prosecution history, including without limitation Office Actions, Amendments, Remarks, and any other potentially relevant documents, Turconi et al.

International Search Report dated Oct. 16, 2006 for PCT Appl. No. PCT/EP2006/007612.

Response to International Search Report dated Dec. 18, 2006 for PCT Appl. No. PCT/EP2006/007612, filed Jan. 8, 2006.

Written Opinion dated Feb. 4, 2008 under Rule 43 for PCT Appl. No. PCT/EP2006/007612.

IPER and Response dated Dec. 10, 2007 for PCT Appl. No. PCT/EP2006/007612.

R. K. Aggarwal et al., *Qualifications of Solutions for Improving Fatigue Life at SCR Tough Down Zone*, Deep Offshore Technology Conference, Vitoria, Espirito Santo, Brazil (Nov. 8-10, 2005) 12 pages.

A. Izquierdo et al., *Qualification of Weldable X65 Grade Riser Sections with Upset Ends to Improve Fatigue Performance of Deepwater Steel Catenary Risers*, Proceedings of the Eighteenth International Offshore and Polar Engineering,Conference, Vancouver, BC, Canada (Jul. 6-11, 2008) p. 71.

Tenaris Newsletter for Pipeline Services, May 2003, pp. 1-8.

Tenaris Newsletter for Pipeline Service, Apr. 9, 2005, 1-8.

R. Thethi and D. Walters, *Alternative Construction for High Pressure High Temperature Steel Catenary Risers*, OPT USA (Sep. 2003) p. 1-13.

* cited by examiner

HIGH-STRENGTH STEEL FOR SEAMLESS, WELDABLE STEEL PIPES

RELATED APPLICATIONS

This application is a U.S. National Phase of International Application No. PCT/EP2006/007612, filed Aug. 1, 2006 and published in English on Feb. 15, 2007, which claims priority to Mexican Patent Application No. PA/a/2005/008339, filed Aug. 4, 2005.

The present invention refers generally to steel used for making a material of seamless steel pipes, such as oil well pipes or line pipes and, more specifically, to high-strength alloy steels used to manufacture weldable steel seamless pipes.

BACKGROUND OF THE INVENTION

The technological evolution in the offshore sector tends to an increasing use of high strength steels with yield strength in the range from 80 to 100 ksi for flowlines and risers. In this context, one key component is the riser system, which becomes a more significant factor as water depth increases. Riser system costs are quite sensitive to water depth.

Although in-service conditions and the sensitiveness of environmental loads (i.e. wave and current) are different for the two riser types Top Tension Risers (TTRs) and Steel Catenary Risers (SCRs) for ultra-deep environment, the requirement to reduce raiser weight is extremely important. By reducing the weight of the line, there is a decrease in the cost of the pipe and a significant impact on the tensioning system used to support the riser.

In addition, using high-strength alloy steels can decrease the wall thickness of a pipe up to 30% due to the more efficient design. For riser systems, which rely on buoyancy in the form of aircans for top tension, the thinner wall pipe available with high strength steel allows reduced buoyancy requirements which, in turn, can reduce the hydrodynamic loading on these components and, thus, improve riser response. Riser systems where the tension is reacted by the host facility benefit from high strength steel as the total payload is reduced.

In the past years, there have been several types of high-strength alloy steels developed in the field of quenched and tempered (QT) seamless pipes. These seamless pipes combine both high strength with good toughness and good girth weldability. However, these seamless pipes have wall thickness of up to 40 mm and outside diameter not greater than 22 inches and, thereby, are quite expensive and can only reach a yield strength below 100 ksi after quenching and tempering.

For example, high-strength, weldable steels for seamless pipes have been known in U.S. Pat. No. 6,217,676 which describes an alloy steel that can reach grades of up to X80 after quenching and tempering and has excellent resistance to wet carbon dioxide corrosion and seawater corrosion, comprising in weight % more than 0.10 and 0.30 C, 0.10 to 1.0 Si, 0.1 to 3.0 Mn, 2.5 to less than 7.0 Cr and 0.01 to 0.10 Al, the balance includes Fe and incidental impurities including not more than 0.03% P. However, these types of steels can not reach grades higher than X80 and are quite expensive due to the high content of Cr.

Likewise, U.S. patent application Ser. No. 09/341,722 published Jan. 31, 2002 describes a method for making seamless line pipes within the yield strength range from that of grade X52 to 90 ksi, with a stable elastic limit at high application temperatures by hot-rolling a pipe blank made from a steel which contains 0.06-018% C, Si≦0.40%, 0.80-1.40% Mn, P≦0.025%, S≦0.010%, 0.010-0.060% Al, Mo≦0.50%, Ca≦0.040%, V≦0.10%, Nb≦0.10%, N≦0.015%, and 0.30-1.00% W. However, these types of steels can not reach yield strength higher than 100 ksi and are not weldable in a wide range of heat inputs.

It is, therefore, desirable and advantageous to provide an improved high-strength, weldable alloy steel for seamless pipes to be used in a riser system with yield strength well above 90 ksi and with a wall thickness (WT) to outside diameter (OD) ratio adequate to expected collapse performance which obviates prior art shortcomings and which is able to meet good mechanical properties in the pipe body and weld.

BRIEF DESCRIPTION OF THE INVENTION

The characteristic details of the novel alloy steel of the present invention are clearly shown in the following description, tables and drawings. It is a first object of the present invention to provide alloy steel containing, by weight percent, C 0.03-0.13%, Mn 0.90-1.80%, Si≦0.40%, P≦0.020%, S≦0.005%, Ni 0.10-1.00%, Cr 0.20-1.20%, Mo 0.15-0.80%, Ca≦0.040%, V≦0.10%, Nb≦0.040%, Ti≦0.020% and N≦0.011% for making high-strength, weldable steel seamless pipe, characterized in that the microstructure of the alloy steel is a mixture of bainite and martensite and the yield stress is at least 621 MPa (90 ksi), weldable in a wide range of heat inputs, comprising a chemical composition that is capable of achieving excellent mechanical properties of the pipe body and good mechanical characteristics of the girth weld.

It is a second object of the present invention to provide a high-strength, weldable steel seamless pipe, comprising an alloy steel containing, by weight percent, C 0.03-0.13%, Mn 0.90-1.80%, Si≦0.40%, P≦0.020%, S≦0.005%, Ni 0.10-1.00%, Cr 0.20-1.20%, Mo 0.15-0.80%, Ca≦0.040%, V≦≦0.10%, Nb≦0.040%, Ti≦0.020% and N≦0.011% also characterized in that the microstructure of the alloy steel is predominantly martensite and the yield stress is at least 690 MPa (100 ksi).

DETAILED DESCRIPTION OF THE DRAWINGS

The details being referred to in the drawings are described next for a better understanding of the present invention:

DETAILED DESCRIPTION OF THE INVENTION

Figure 1:
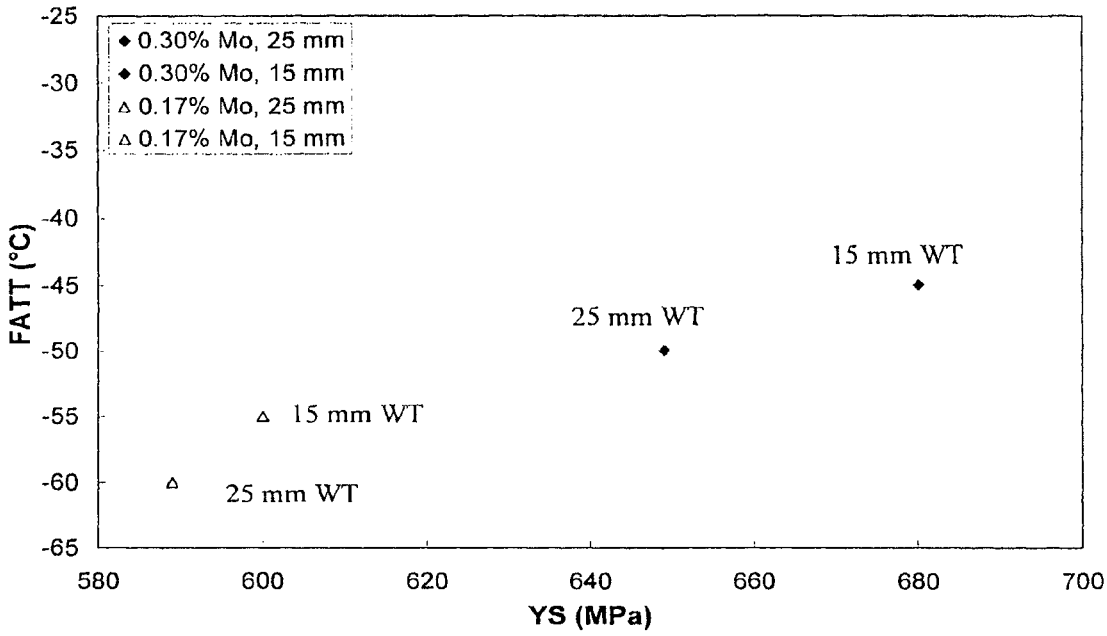
FIG. 1 shows the effect of thickness and Mo content on yield strength (YS) and fracture appearance transition temperature (FATT) of materials of the present invention.

In accordance with a first aspect of the invention, an alloy steel comprising, by weight percent, C 0.03-0.13%
Mn 0.90-1.80%
Si≦0.40%
P≦0.020%

S≦0.005%
Ni 0.10-1.00%
Cr 0.20-1.20%
Mo 0.15-0.80%
Ca≦0.040%
V≦≦0.10%
Nb≦0.040%
Ti≦0.020%
N≦0.011% for making high-strength steel seamless pipe, weldable in a wide range of heat inputs. The chemical composition of the present invention provides an improved high-strength, weldable alloy steel seamless pipe to be used in a riser system with a yield strength greater than 90 ksi and with a wall thickness to outside diameter ratio that is high enough for the manufacturing limit of a welded pipe as a riser and where flowline wall thickness increases to provide sufficient resistance for operating pressures that more frequently are greater than 10 ksi.

The reasons for selecting the chemical composition of the present invention are described below:

Carbon: 0.03%-0.13%

Carbon is the most inexpensive element and with the greatest impact on the mechanical resistance of steel, therefore, its content percentage can not be too low. Furthermore, Carbon is necessary to improve hardenability of the steel and the lower its content in the steel, the more weldable is the steel and higher the level of alloying elements can be used. Therefore, the amount selected of carbon is selected in the range of 0.03 to 0.13%.

Manganese: 0.90%-1.80%

Manganese is an element which increases the hardenability of steel. Not Less than 0.9% of manganese is necessary to improve the strength and toughness of the steel. However, more than 1.80% decreases resistance to carbon dioxide corrosion, toughness and weldability of steel.

Silicon: Less than 0.40%

Silicon is used as a deoxidizing agent and its content below 0.40% contributes to increase strength and softening resistance during tempering. More than 0.40% has an unfavorable effect on the workability and toughness of the steel.

Phosphorus: Less than 0.020%

Phosphorus is inevitably contained in the steel. However, since this element segregates on grain boundaries and decreases the toughness of the base material, heat affected zone (HAZ) and weld metal (WM), its content is limited to 0.020%.

Sulphur: Less than 0.005%

Sulphur is also inevitably contained in the steel and combines with Manganese to form Manganese Sulfide which deteriorates the toughness of the base material, heat affected zone (HAZ) and weld metal (WM). Therefore, the content of sulphur is limited to not more than 0.005%.

Nickel: 0.10% to 1.00%

Nickel is an element which increases the toughness the base material, heat affected zone (HAZ) and weld metal (WM); however, above a given content this positive effect is gradually reduced due to saturation. Therefore, the optimum content range for nickel is from 0.10 to 1.00%.

Chromium: 0.20% to 1.20%

Chromium improves the hardenability of the steel to increase strength and corrosion resistance in a wet carbon dioxide environment and seawater. Large amounts of Chromium make the steel expensive and increase the risk of undesired precipitation of Cr rich nitrides and carbides which can reduce toughness and resistance to hydrogen embrittlement. Therefore, the preferred range is between 0.20 and 1.20%.

Molybdenum: 0.15% to 0.80%

Molybdenum contributes to increase strength by solid solution and precipitation hardening, and enhances resistance to softening during tempering of the steel. It prevents the segregation of detrimental tramp elements on the boundaries of the austenitic grain. Addition of Mo is essential for improving hardenability and hardening solid solution, and in order to exert the effect thereof, the Mo content must be 0.15% or more. If the Mo content exceeds 0.80%, toughness in the welded joint is particularly poor because this element promotes the formation of high C martensite islands, containing retained austenite (MA constituent). Therefore, the optimum content range for this element is 0.15% to 0.80%.

Calcium: Less than 0.040%

Calcium combines with sulfur and oxygen to create sulfides and oxides and then these transform the hard and high melting point oxide compounds into a low melting point and soft oxide compounds which improve the fatigue resistance of the steel. The excessive addition of calcium causes undesired hard inclusions on steel product. Summing up these effects of calcium, when calcium is added, its content is limited to not more than 0.040%.

Vanadium: Less than 0.10%

Vanadium precipitates from solid solution as carbides and nitrides, therefore, increases the strength of the material by precipitation hardening. However, to avoid an excess of carbides or carbonitrides in the weld, its content is limited to not more than 0.10%.

Niobium: Less than 0.040%

Niobium also precipitates from solid solution in the form of carbides and nitrides and, therefore, increases the strength of the material. The precipitation of carbides or nitrides rich in niobium also inhibits excessive grain growth. However, when the Nb content exceeds 0.04%, undesirable excessive precipitation occurs with consequent detrimental effects on toughness. Thus the preferred content of this element should not exceed 0.040%.

Titanium: Less than 0.020%

Titanium is a deoxidizing agent which is also used to refine grains through nitride precipitates, which hinder grain boundary movement by pinning. Amounts larger than 0.020% in the presence of elements such as Nitrogen and Carbon promote the formation of coarse carbonitrides or nitrides of Titanium which are detrimental to toughness (i.e. increase of the transition temperature). Therefore, the content of this element should not exceed 0.020%.

Nitrogen: Less than 0.010%

The amount of Nitrogen should be kept below 0.010% to develop in the steel an amount of precipitates which does not decrease the toughness of the material.

In accordance with a second aspect of the invention, a high-strength, weldable, steel seamless pipe, comprising an alloy steel containing, by weight percent, C 0.03-0.13%
Mn 0.90-1.80%
Si≦0.40%
P≦0.020%
S≦0.005%
Ni 0.10-1.00%
Cr 0.20-1.20%
Mo 0.15-0.80%
Ca≦0.040%
V≦0.10%
Nb≦0.040%
Ti≦0.020%
N≦0.011% also characterized in that the microstructure of the alloy steel is predominantly martensite and the yield stress is at least 690 MPa (100 ksi).

The seamless pipe is weldable in a heat input range between 15 KJ/in and 40 KJ/in and shows good fracture toughness characteristics (Crack Tip Opening Displacement (CTOD)) in both pipe body and heat affected zone.

The present invention is capable to fulfill the mechanical requirements for shallow and deepwater projects and achieves the following mechanical properties of the pipe and of the girth weld, as shown in Tables 1 and 2 respectively, with respect to strength, hardness, and toughness.

TABLE 1

| PARENT PIPE MECHANICAL PROPERTIES | |
|---|---|
| Minimum Yield Strength | 100 ksi |
| Minimum Ultimate Tensile Strength (UTS) | 110 ksi |
| Yield to Tensile Ratio | ≦0.95 |
| Minimum Elongation | 18% |
| Charpy V-Notch Absorbed Energy at −10° C. (transverse) | 80 Joules Minimum Individual |
| Minimum Crack Tip Opening Displacement (CTOD) at −10° C. | 0.25 mm |

TABLE 2

| WELD MECHANICAL PROPERTIES | |
|---|---|
| Minimum Yield Strength | 115 ksi |
| Maximum Hardness | 325 HV10 |
| Minimum Crack Tip Opening Displacement (CTOD) at −10° C. | 0.25 mm |

The critical ranges of size, weight, pressure, mechanical and chemical composition apply to a seamless pipe of up to 16 inches outside diameter ranging between 12 mm to 30 mm wall thickness, respectively, for Quenching & Tempering (Q&T) seamless pipes with yield strength greater than 100 ksi. Said characteristics were achieved through a tailored metallurgical design of high-strength pipes by means of metallurgical modeling, laboratory tests, and industrial trials. The results show that the manufacture of Q&T seamless pipes with yield strength grater than 100 ksi is possible at least within a certain dimensional range.

To achieve the high-strength Q&T seamless pipe of the present invention, with yield strength greater than 100 ksi, in weldable steel, tests were conducted in steels of pipe geometry in the following range: outside diameter (OD) varying from 6 inches to 16 inches and wall thickness (WT) varying from 12 to 30 mm. The representative geometry was defined due to the fact that the chemical composition of the present invention is tied to the OD/WT ratio. The most promising steels were identified as having Nb microaddition with carbon content from 0.07 to 0.11%, where the lower the carbon content in the steel the higher the level of alloying elements to be used, 1-1.6% Mn, as well as optimized additions of Mo, Ni, Cr and V; carbon equivalent (Ceq=C+Mn/6+(Cr+Mo+V)/5+(Cu+Ni)/15) ranges from 0.45% to 0.59%.

Hot rolling and various Q&T treatments were carried on laboratory steels with base composition 0.085% C, 1.6% Mn, 0.4% Ni, 0.22% Cr, 0.05% V and 0.03% Nb and 017% Mo as well as 0.29% Mo content.

The results of the tests led to a yield to tensile (Y/T) ratio always below 0.95. Steel with 0.29% Mo allowed to produce a seamless Q&T steel with a yield strength (YS) close to 100 ksi (680 MPa) with a Fracture Appearance Transition Temperature (FATT) of −50° C. (austenitizing at 920° C. and tempering at 600° C. to 620° C.).

Figure 2:
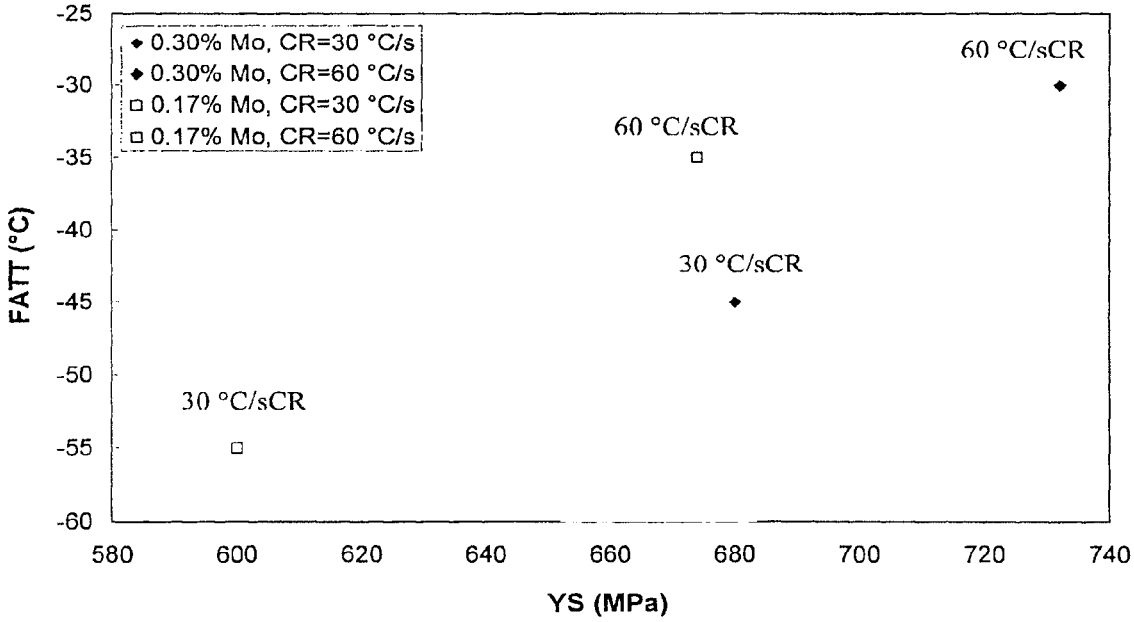
FIG. 2 illustrates the effect of the cooling rate (CR) and Mo content on YS and FATT in a pipe of 15 mm wall thickness of the present invention.

As illustrated in FIGS. 1 and 2, mechanical properties are not so sensitive to tempering temperatures although toughness slightly improved with the increase of this parameter remaining strength to suitable levels. As shown in FIG. 1, the FATT vs YS behavior is reported for samples of 15 mm and 25 mm of both 0.17% and 0.30% Mo content. These samples were quenched reproducing the same cooling rate. Test results showed that YS depends on the Mo content (as the higher the Mo content, the higher the Yield Strength) due to the improved hardenability, if the same cooling rate is considered.

The effect of the cooling rate was also evaluated on steels with 0.17% and 0.30% Mo after austenitization at 920° C. and tempering at 620° C. As can be observed in Table 3, if the toughness, measured as FATT value normalized to a given yield strength, is considered, increasing cooling rate improves the strength without significant detrimental effects on toughness of the material for both Mo contents.

TABLE 3

| Mo, % | CR, ° C./s | YS, MPa | Normalized FATT, ° C. |
|---|---|---|---|
| 0.30 | 30 | 680 | −69.0 |
| | 60 | 732 | −69.6 |
| 0.17 | 30 | 600 | −55.0 |
| | 60 | 674 | −57.2 |

According to this emerging picture, two industrial heats, coded T1 and D1 (Table 4), were produced with a similar chemical composition, comparable to that of the laboratory steel with high Mo.

TABLE 4

CHEMICAL COMPOSITION (mass %)

| HEAT | C | Mn | Si | P | S (ppm) | Ni | Cr | Mo | Ca (ppm) | V |
|---|---|---|---|---|---|---|---|---|---|---|
| T1 | 0.09 | 1.51 | 0.24 | 0.01 | 16 | 0.44 | 0.26 | 0.25 | 20 | 0.064 |
| D1 | 0.10 | 1.44 | 0.28 | 0.01 | 20 | 0.44 | 0.21 | 0.23 | <5 | 0.070 |
| T2 | 0.07 | 1.67 | 0.22 | 0.01 | 9 | 0.51 | 0.5 | 0.32 | 10 | 0.042 |
| D2 | 0.11 | 1.48 | 0.25 | 0.02 | 20 | 0.53 | 0.53 | 0.31 | <5 | 0.058 |
| T3 | 0.10 | 1.27 | 0.34 | 0.01 | 9 | 0.22 | 0.51 | 0.52 | 17 | <0.005 |

| HEAT | Nb | Ti (ppm) | N (ppm) | Cu | Al | Sn | As | B | Ceq |
|---|---|---|---|---|---|---|---|---|---|
| T1 | 0.029 | <40 | 60 | 0.126 | 0.023 | 0.007 | 0.005 | <0.005 | 0.49 |
| D1 | 0.026 | <40 | 50 | 0.15 | 0.022 | 0.007 | 0.005 | <0.005 | 0.48 |
| T2 | 0.026 | 80 | 50 | 0.14 | 0.023 | 0.007 | 0.005 | <0.005 | 0.56 |
| D2 | 0.026 | <40 | 48 | 0.12 | 0.024 | 0.007 | 0.005 | <0.005 | 0.58 |
| T3 | 0.025 | 70 | 43 | 0.119 | 0.020 | 0.007 | 0.005 | <0.005 | 0.54 |

Pipes with OD=323.9 mm and WT=15-16 mm were produced. These pipes were austenitized at 900-920° C. and tempered at 610-630° C. Likewise, 25 mm thick pipes were manufactured and austenitized at 900° C. and tempered at 600° C.

On the basis of the results from the first trial, two other heats, coded T2 and D2 (Table 4), were cast with a similar richer chemical composition (0.3% Mo; 0.5% Cr; 0.5% Ni; 0.05% V; 0.026% Nb), except for C and Mn contents, which were respectively lower and higher in heat T2 (0.07% C; 1.67% Mn) compared with heat D2 (0.11% C; 1.48% Mn). Finally, a third heat (T3 in Table 4) was specifically designed to achieve very high contents of martensite after quenching and, hence, yield strength values higher than 100 ksi in 25-30 mm WT seamless pipes.

One of the remarkable characteristics of the alloy steel according to the present invention is its microstructure characterized by the amount of martensite and the size of packets and sub-grains.

In order to relate the strength and toughness behavior to microstructure, materials from laboratory and industrial trials have been considered for a deeper metallographic investigation. Similarly, conventional X65 and X80 grade materials were included in this analysis.

Optical microscopy (OM) was used in order to measure the average size of the prior austenite grains (PAGS), whilst scanning electron microscopy (SEM) and transmission electron microscopy (TEM) were applied to recognize and assess the content of martensite. In addition to these techniques, Orientation Imaging Microscopy (OIM) was also applied to give quantitative information on local orientation and crystallography. In particular, this technique allowed to detect subgrains (low-angle boundaries with misorientation <5°) and packets (delimited by high-angle boundaries with misorientation >50°).

Figure 3:
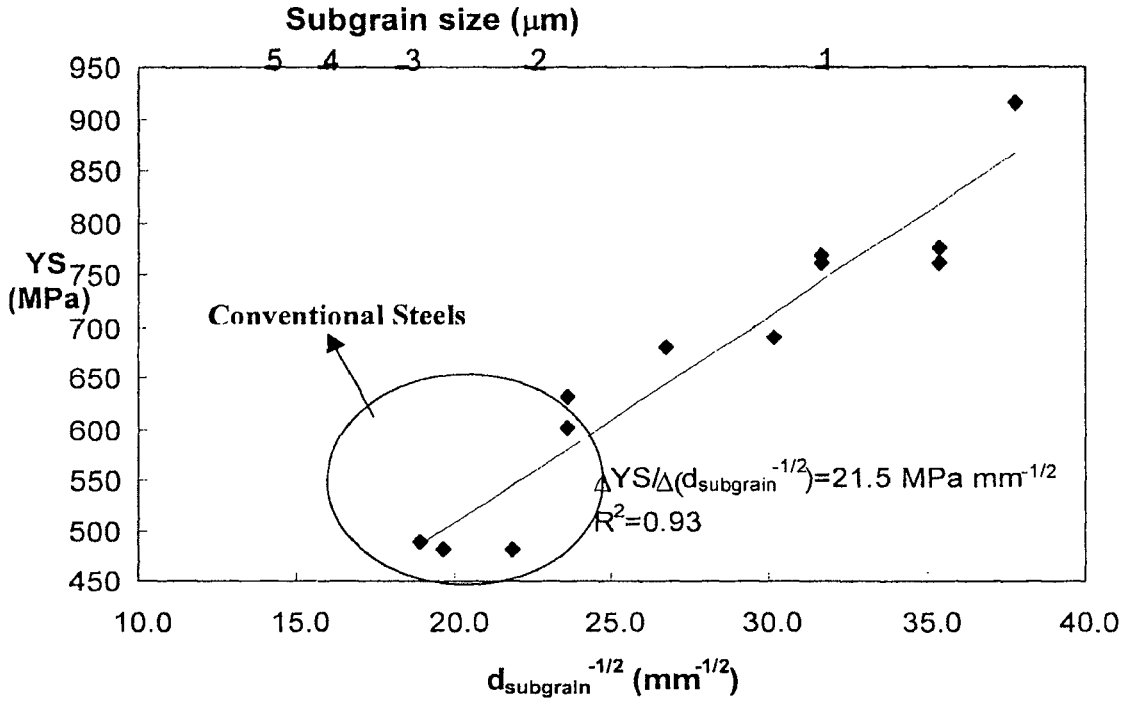
FIG. 3 shows the effect of mean sub-grain size on the yield strength of Q&T steels from the present invention.
Figure 4:
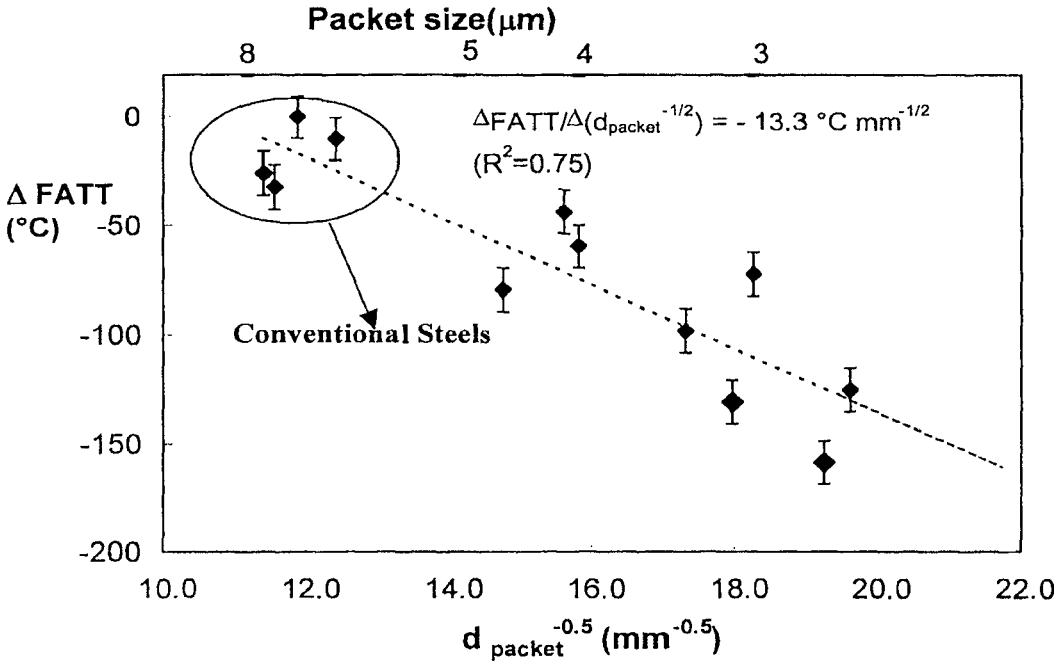
FIG. 4 shows the relationships between FATT change and the inverse square root of the packet size for Q&T steels with various amounts of martensite.

The mean sub-grain size is the key microstructural parameter in defining the yield strength of these materials according to an almost linear relationship with the inverse of square root of this parameter (FIG. 3). On the other hand, the toughness of the different materials was related to the inverse square root of the packet size. Particularly, a normalised FATT, referred to a same yield strength level, has been introduced using the relationship $\Delta FATT/\Delta YS=-0.3°$ C./MPa. Results show an improvement of toughness with packet size refinement (FIG. 4).

Figure 5:
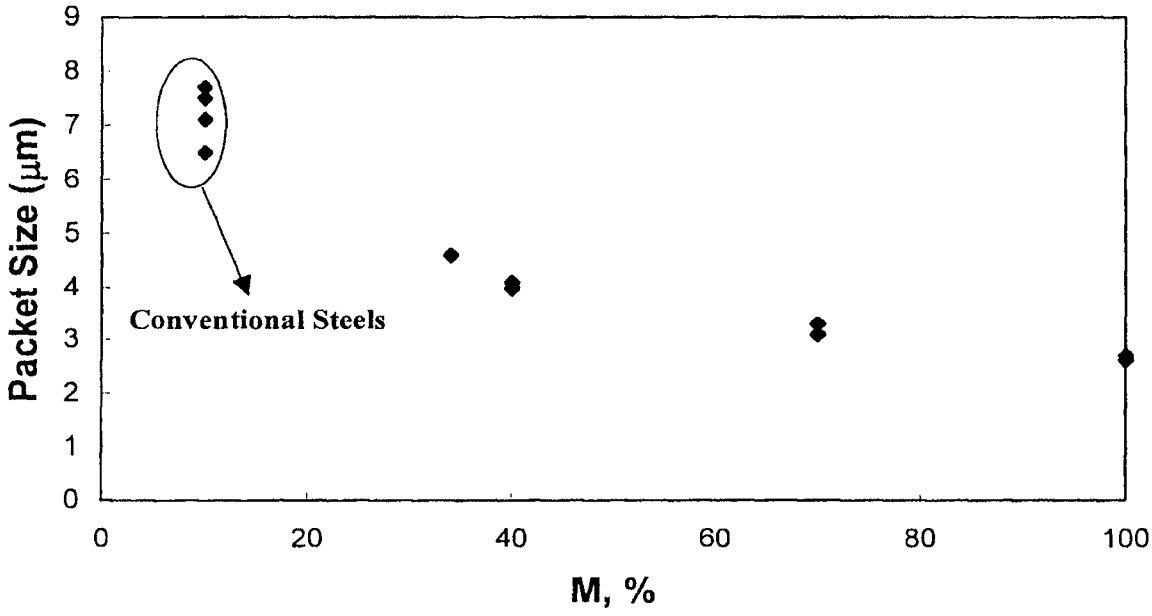
FIG. 5 shows packet size for Q&T steels of the present invention with as-quenched microstructure constituted of martensite (M>30%).

Finer packet sizes (FIG. 5) are obtained when the as-quench microstructure comprises mainly low-C martensite (M>60%).

Figure 6:
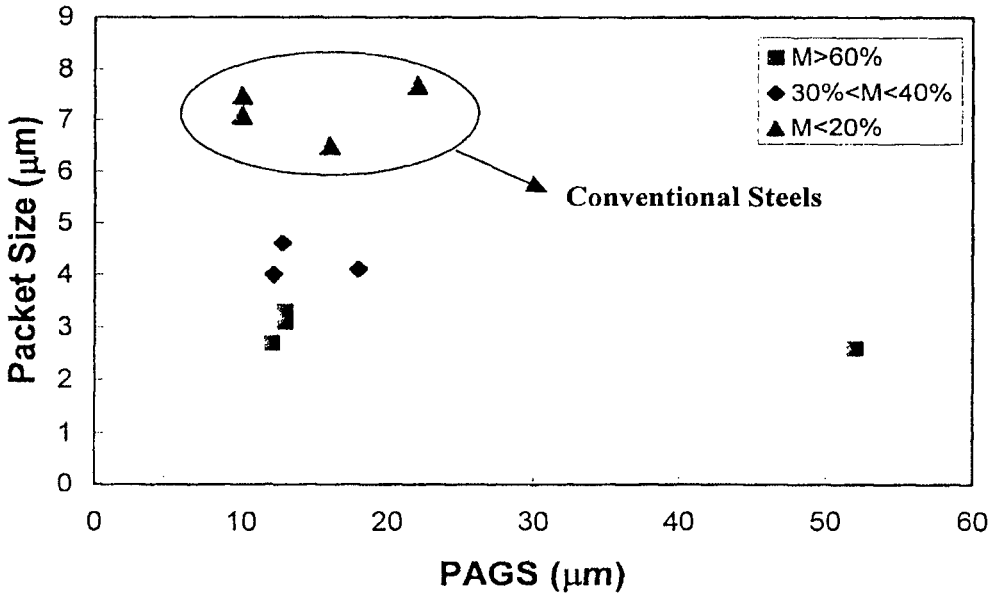
FIG. 6 shows that in materials object of the present invention, with a predominant martensitic structure, the packet size is practically independent of the prior austenite grain size (PAGS).

FIG. 6 shows that the packet size is practically independent of the prior austenite grain size (PAGS) in materials with a predominant martensitic structure (M>60%). Therefore, a stringent control of austenitizing temperatures to maintain the PAGS fine is not required when the heat treatment is performed on steels that are able to develop a predominant martensitic structure.

All steels in Table 4 according to the examples of the present invention satisfy the yield strength of at least 90 ksi and good toughness level (i.e. FATT≦−30° C.) because they were designed to develop a microstructure with M>30% during industrial quenching of seamless pipes of wall thickness from 12 to 30 mm.

Amounts of martensite greater than 60% were also developed to form after tempering a microstructure with sub-grains smaller than 1.1 μm capable to develop yield strength levels greater than 750 MPa and packets with size smaller than 3 μm that are suitable to reach very low FATT values (<−80° C.).

EXAMPLE 1

Using a heat with chemical composition comprising 0.09% C, 1.51% Mn, 0.24% Si, 0.010% P, 16 ppm S, 0.25% Mo, 0.26% Cr, 0.44% Ni, 0.06% V and 0.029% Nb and pipes with outside diameter of 323.9 mm and wall thickness of 15-16 mm, and austenitizing at 900°-920° C., quenching in a water tank (external and internal cooling of the pipe) and tempering at 610°-630° C., it was found (Table 5) that the 15-16 mm wall thickness seamless Q&T pipe is suitable to develop YS>95 ksi (660 MPa). Using a 25 mm wall thickness pipe with the same chemical composition and outside diameter and austenitizing at 900° C. and tempering at 600° C., it was found that the mm wall thickness seamless Q&T pipe is suitable to develop YS>90 ksi (621 MPa). The FATT values were −65° C. (Table 5).

TABLE 5

| WT (mm) | YS (MPa) | UTS (MPa) | 50% FATT (° C.) |
|---|---|---|---|
| 15 | 680 | 789 | −65 |
| 25 | 630 | 789 | −65 |

EXAMPLE 2

Using a heat with chemical composition comprising 0.10% C, 1.44% Mn, 0.28% Si, 0.010% P, 20 ppm S, 0.230% Mo, 0.26% Cr, 0.070% V, 0.026% Nb, 0.44% Ni and pipes with outside diameter of 323.9 mm and wall thickness of 15-16 mm, austenitizing at 900°-920° C., quenching externally and internally a rotating pipe, and tempering at 610°-630° C., it was found (Table 6) that the 15-16 mm wall thickness seamless Q&T pipe achieves a yield strength higher than 100 ksi (690 MPa).

TABLE 6

| WT (mm) | YS (MPa) | UTS (MPa) | 50% FATT (° C.) |
|---|---|---|---|
| 15 | 775 | 857 | −55 |
| 25 | 700 | 775 | −30 |

EXAMPLE 3

Using a heat with chemical composition comprising 0.11% C, 1.48% Mn, 0.25% Si, 0.016% P, 20 ppm S, 0.31% Mo, 0.53% Cr, 0.058% V, 0.026% Nb, 0.53% Ni and pipes with outside diameter of 323.9 mm and wall thickness of 15-16 mm, and process conditions similar to that of example 2 the mechanical properties shown in Table 7 were developed.

TABLE 7

| WT (mm) | YS (MPa) | UTS (MPa) | 50% FATT (° C.) |
|---|---|---|---|
| 15 | 773 | 840 | −50 |

Compared to example 2 (Table 6), it was found that the Cr and Mo additions do not give additional benefits in terms of toughness, thereby, maintaining the required strength levels for the 15-16 mm wall thickness seamless Q&T pipe.

EXAMPLE 4

Using a heat with chemical composition comprising 0.11% C, 1.48% Mn, 0.25% Si, 0.016% P, 20 ppm S, 0.31% Mo, 0.53% Cr, 0.058% V, 0.026% Nb, 0.53% Ni and pipes with outside diameter of 323.9 mm and wall thickness of 25 mm the mechanical properties shown in Table 8 were developed when the water quenching effectiveness was reduced on purpose.

TABLE 8

| WT (mm) | YS (MPa) | UTS (MPa) | 50% FATT (° C.) |
|---|---|---|---|
| 25 | 760 | 826 | −5 |

Compared with the case of example 2 (Table 6), it was found that the Cr and Mo additions give substantial strength increase (from 700 MPa to 760 MPa) but toughness decreased (FATT from −30° C. to −5° C.). This behavior was related to a low amount of martensite and consequently to a relatively coarse packet.

EXAMPLE 5

Using a heat with chemical composition comprising 0.07% C, 1.67% Mn, 0.22% Si, 0.010% P, 0.042% V, 0.026% Nb, 0.51% Ni, 80 ppm Ti, 9 ppm S, and pipes with outside diameters of 323.9 mm and wall thickness of 15 mm, it was found (Table 9) that Cr and Mo additions (compare this example with example 1) for the same tempering temperature, i.e. 600° C., give higher strength (YS>710 MPa and ΔYS 40 MPa) maintaining good toughness levels (FATT=−60° C.).

TABLE 9

| WT (mm) | YS (MPa) | UTS (MPa) | 50% FATT (° C.) |
|---|---|---|---|
| 15 | 710 | 798 | −60 |
| 25 | 690 | 788 | −65 |

Using a 25 mm wall thickness pipe with the same chemical composition and outside diameter, it was found that the Cr and Mo additions (compare this example with example 1, WT=25 mm), for the same tempering temperature, i.e. 600 C, give a slightly strength increase (ΔYS=30 MPa) without detrimental effect on toughness.

EXAMPLE 6

Using a heat with chemical composition comprising 0.10% C, 1.27% Mn, 0.34% Si, 0.010% P, 0.025% Nb, 0.50% Mo, 0.32% Cr, 0.22% Ni, 70 ppm Ti, 9 ppm S, and pipes with outside diameter of 323.9 mm and wall thickness of 16 mm, it was found (Table 10) that further Mo additions (compare this example with example 5), even using a slightly higher tempering temperature (625° C. vs 600° C.), give higher strength (YS=760 MPa and ΔYS=50 MPa) and also a better toughness (ΔFATT=−60° C.). This behavior, is related to an amount of martensite close to 100%.

TABLE 10

| WT (mm) | YS (MPa) | UTS (MPa) | 50% FATT (° C.) |
|---|---|---|---|
| 16 | 760 | 800 | −120 |
| 25 | 768 | 830 | −90 |

Using a 25 mm wall thickness pipe with the same chemical composition and outside diameter, it was found that Mo addition (compare this example with example 5, WT=25 mm), for the same tempering temperature, i.e. 600 C, give again a strength increase (ΔYS=80 MPa) with very good toughness (FATT=−90° C.). This behavior is related to an amount of martensite higher than 65%.

While the invention has been illustrated and described as embodied, it is not intended to be limited to the details shown since various modifications and structural changes may be made without departing in any way from the spirit of the present invention. The embodiments were chosen and described in order to best explain the principles of the invention and practical application to enable a person skilled in the art to best utilize the invention and various embodiments with various modifications as are suited to the particular use contemplated.

What is claimed is:

1. A weldable high strength seamless pipe comprising an alloy steel containing, by weight percent, C 0.07-0.13%
Mn 0.90-1.40%
Si <0.40%
P <0.020%
S <0.005%
Ni 0.15-0.50%
Cr >0.25%
Mo >0.27%
Ca <0.035%
V <0.09%
Nb <0.030%
Ti <0.009%
N <0.011% the balance being Fe and incidental impurities, wherein the microstructure of the steel is more than 30% martensite and wherein the yield stress is greater than 690 MPa, and wherein the mean subgrain size is smaller than 1.5 μm and wherein the packet size is smaller than 4.8 μm, and wherein the 50% fracture appearance transition temperature (FATT) is <−30° C as measured in accordance with ASTM E23.

2. The weldable high strength seamless pipe of claim 1, wherein the microstructure of the alloy steel is more than 60% martensite and wherein the yield stress is greater than 750 MPa and wherein the mean subgrain size is smaller than 1.1 μm and wherein the packet size is smaller than 3 μm and wherein the 50% FATT is <−80° C.

3. The weldable high-strength seamless pipe of claim 1, comprising at least 70 ppm Ti.

4. The weldable high-strength seamless pipe of claim 1, comprising 0.27-0.60-wt % Mo.

5. The weldable high-strength seamless pipe of claim 1, comprising at least 0.022-wt % Nb.

6. The weldable high-strength seamless pipe of claim 1, comprising at least 0.01-wt % P.

7. The weldable high-strength seamless pipe of claim 1, comprising 0.25-0.60-wt % Cr.

8. The weldable high-strength seamless pipe of claim 1, comprising at least 0.15-wt % Ni.

9. A method for producing a weldable high-strength seamless pipe, comprising:

providing an alloy steel containing, by weight percent, C 0.07-0.13% Mn 0.90-1.40% Si <0.40% P <0.020% S <0.005% Ni 0.15-0.50% Cr 0.25-0.60% Mo 0.27-0.60% Ca <0.035% V <0.09% Nb <0.030% Ti <0.012% N <0.011% the balance being Fe and incidental impurities;

piercing and hot rolling the alloy steel to form a pipe;

austenitizing the alloy steel pipe;

quenching the alloy steel pipe in a water tank while rotating the pipe; and tempering the alloy steel pipe;

wherein the microstructure of the pipe is more than 30% martensite and wherein the yield stress is greater than 690 MPa and wherein the mean subgrain size is smaller than 1.5 μm and wherein the packet size is smaller than 4.8 μm and wherein the 50% fracture appearance transition temperature (FATT) is <−30° C. as measured in accordance with ASTM E23.

10. An alloy steel comprising, by weight percent, C 0.07-0.13% Mn 0.90-1.40% Si <0.40% P <0.020% S <0.005% Ni 0.15-0.50% Cr 0.25-0.60% Mo 0.27-0.60% Ca <0.035% V <0.09% Nb <0.030Ti <0.012% N <0.011% the balance being Fe and incidental impurities, wherein the microstructure of the steel is more than 60% martensite and wherein the yield stress is greater than 750 MPa, and wherein the mean subgrain size is smaller than 1.1 μm and wherein the packet size is smaller that 3 μm, and wherein the 50% fracture appearance transition temperature (FATT) is <-80° C. as measured in accordance with ASTM E23.

11. The alloy of claim 10, wherein the alloy is formed into a pipe.

* * * * *

UNITED STATES PATENT AND TRADEMARK OFFICE

CERTIFICATE OF CORRECTION

PATENT NO. : 8,007,603 B2
APPLICATION NO. : 11/997900
DATED : August 30, 2011
INVENTOR(S) : Alfonso Izquierdo Garcia et al.

It is certified that error appears in the above-identified patent and that said Letters Patent is hereby corrected as shown below:

Title Page, (Item 57) Abstract, Line 15, delete "V≤≤0.10%," and insert therefore, --V≤0.10%,--.

At Column 2, Line 33, delete "V≤≤0.10%," and insert therefore, --V≤0.10%,--.

At Column 3, Line 6, delete "V≤≤0.10%" and insert therefore, --V≤0.10%--.

At Column 5, Line 37, delete "grater" and insert therefore, --greater--.

At Column 8, Line 18, delete "mm wall" and insert therefore, --25 mm wall--.

At Column 9, Line 39, delete "ΔYS 40 MPa)" and insert therefore, --ΔYS=40 MPa)--.

At Column 10, Lines 29-41, in Claim 1, delete

C 0.07-0.13%
Mn 0.90-1.40%
Si <0.40%
P <0.020%
S <0.005%
Ni 0.15-0.50%
Cr >0.25%
Mo >0.27%
Ca <0.035%
V <0.09%
Nb <0.030%
Ti <0.009%
" N <0.011% "

Signed and Sealed this
Eleventh Day of September, 2012

David J. Kappos

David J. Kappos
*Director of the United States Patent and Trademark Office* and insert therefore,

| | |
|---|---|
| C | 0.07-0.13% |
| Mn | 0.90-1.40% |
| Si | ≤ 0.40% |
| P | ≤ 0.020% |
| S | ≤ 0.005% |
| Ni | 0.15-0.50% |
| Cr | ≥ 0.25% |
| Mo | ≥ 0.27% |
| Ca | ≤ 0.035% |
| V | ≤ 0.09% |
| Nb | ≤ 0.030% |
| Ti | ≤ 0.009% |
| N | ≤ 0.011% |

-- --.

At Column 11, Lines 3-7, in Claim 9, delete

C 0.07-0.13% Mn 0.90-1.40% Si <0.40% P <0.020% S <0.005% Ni 0.15-0.50% Cr 0.25-0.60% Mo 0.27-0.60% Ca <0.035% V <0.09% Nb <0.030% Ti <0.012% N <0.011% ".

and insert therefore,

| | |
|---|---|
| C | 0.07-0.13% |
| Mn | 0.90-1.40% |
| Si | $\leq$ 0.40% |
| P | $\leq$ 0.020% |
| S | $\leq$ 0.005% |
| Ni | 0.15-0.50% |
| Cr | 0.25-0.60% |
| Mo | 0.27-0.60% |
| Ca | $\leq$ 0.035% |
| V | $\leq$ 0.09% |
| Nb | $\leq$ 0.030% |
| Ti | $\leq$ 0.012% |
| N | $\leq$ 0.011% |

-- --.

At Column 12, Lines 4-7, in Claim 10, delete

“ C 0.07-0.13% Mn 0.90-1.40% Si <0.40% P <0.020% S <0.005% Ni 0.15-0.50% Cr 0.25-0.60% Mo 0.27-0.60% Ca <0.035% V <0.09% Nb <0.030Ti <0.012% N <0.011% ”

and insert therefore,

| | |
|---|---|
| C | 0.07-0.13% |
| Mn | 0.90-1.40% |
| Si | ≤0.40% |
| P | ≤ 0.020% |
| S | ≤ 0.005% |
| Ni | 0.15-0.50% |
| Cr | 0.25-0.60% |
| Mo | 0.27-0.60% |
| Ca | ≤ 0.035% |
| V | ≤ 0.09% |
| Nb | ≤ 0.030% |
| Ti | ≤ 0.012% |
| N | ≤ 0.011% |

--.

At Column 12, Line 11, in Claim 10, delete “that” and insert therefore, --than--.